US006390704B1

(12) United States Patent
Baudino et al.

(10) Patent No.: US 6,390,704 B1
(45) Date of Patent: May 21, 2002

(54) WRITING IMPLEMENT

(75) Inventors: Rodney J. Baudino, Woodridge; Charles E. Bain, Dundee, both of IL (US)

(73) Assignee: Berol Corporation, Freeport, IL (US)

( * ) Notice: Subject to any disclaimer, the term of this patent is extended or adjusted under 35 U.S.C. 154(b) by 0 days.

(21) Appl. No.: 09/709,848

(22) Filed: Nov. 10, 2000

(51) Int. Cl.[7] ..... A46B 5/02
(52) U.S. Cl. ..... 401/6; 16/430
(58) Field of Search ..... 401/57, 6, 7; D19/35, D19/41, 47, 48, 49, 50, 51

(56) References Cited

U.S. PATENT DOCUMENTS

| | | | | | |
|---|---|---|---|---|---|
| 99,955 | A | * | 2/1870 | Rowell et al. | 401/6 |
| 768,985 | A | | 8/1904 | Goldsmith | |
| 779,082 | A | | 1/1905 | Huber et al. | |
| 1,376,115 | A | | 4/1921 | Record | |
| 1,395,793 | A | | 11/1921 | Broschart | |
| 1,597,520 | A | | 8/1926 | Fischer | |
| 1,761,407 | A | * | 6/1930 | O'Sullivan | D19/48 |
| D106,326 | S | | 10/1937 | Ressinger | |
| 2,173,451 | A | | 9/1939 | Lorber | |
| 2,236,194 | A | | 3/1941 | Lorber | 120/103 |
| D145,587 | S | | 9/1946 | Reynolds | D74/17 |
| D149,672 | S | * | 5/1948 | Phillips | D19/48 |
| 2,443,571 | A | | 6/1948 | Wherry | 120/103 |
| D179,425 | S | * | 12/1956 | Parker | D19/50 |
| 2,911,950 | A | | 11/1959 | Freeman | 120/42.4 |
| 2,985,906 | A | | 5/1961 | Reimann | 15/507 |
| 3,154,016 | A | * | 10/1964 | Frey | 16/403 |
| D240,817 | S | | 8/1976 | Funshashi | D19/6 |
| 4,595,307 | A | | 6/1986 | Heyden | 401/117 |
| D284,773 | S | | 7/1986 | Schwartz et al. | D19/48 |
| D289,304 | S | | 4/1987 | Giugiaro | D19/48 |
| 5,000,599 | A | | 3/1991 | McCall et al. | 401/6 |
| 5,009,533 | A | | 4/1991 | Kageyama | 401/65 |
| D319,844 | S | | 9/1991 | Grotsch et al. | D19/48 |
| D334,589 | S | | 4/1993 | Shike et al. | D19/36 |
| 5,294,206 | A | | 3/1994 | Mukunoki | 401/206 |
| 5,354,140 | A | | 10/1994 | Diakoulas | 401/6 |
| D355,673 | S | | 2/1995 | Takashaski | D19/48 |
| D361,346 | S | | 8/1995 | Johnson | D19/50 |
| 5,468,083 | A | | 11/1995 | Chesar | 401/6 |
| 5,555,602 | A | | 9/1996 | Leamond | 15/428 |
| D378,601 | S | | 3/1997 | Sakuno | D19/48 |
| D393,484 | S | | 4/1998 | Schubert | D19/42 |
| 5,735,622 | A | | 4/1998 | Melnick et al. | 401/96 |
| D402,693 | S | | 12/1998 | Sunaga | D19/48 |
| 5,876,134 | A | | 3/1999 | Tsent et al. | 401/6 |
| 5,913,629 | A | | 6/1999 | Hazard | 401/33 |
| 5,926,901 | A | | 7/1999 | Tseng et al. | 15/167.1 |
| D414,807 | S | | 10/1999 | Baudino et al. | D19/55 |
| 5,988,909 | A | | 11/1999 | Luke, Jr. et al. | 401/6 |
| D417,891 | S | | 12/1999 | Izushima | D19/48 |
| 5,997,200 | A | | 12/1999 | Kageyama et al. | 401/6 |
| 6,019,534 | A | | 2/2000 | Heins | 401/6 |
| D423,577 | S | | 4/2000 | Baudino et al. | D19/48 |
| D423,578 | S | | 4/2000 | Izushima | D19/48 |
| 6,056,462 | A | * | 5/2000 | Fukai et al. | 401/6 |

* cited by examiner

*Primary Examiner*—David J. Walczak
(74) *Attorney, Agent, or Firm*—Marshall, Gerstein & Borun

(57) ABSTRACT

A writing implement has a grip for providing improved comfort and stability to the user. The writing implement includes a barrel having a front end and a writing member partially disposed in the barrel, the writing member having a tip extending outside the front end of the barrel. A resilient gripping portion is attached to the barrel and defines an outer surface. A column of grooves are formed in the gripping portion outer surface. The grooves are aligned longitudinally to form interposed ribs shaped to resist slippage away from the tip.

19 Claims, 1 Drawing Sheet

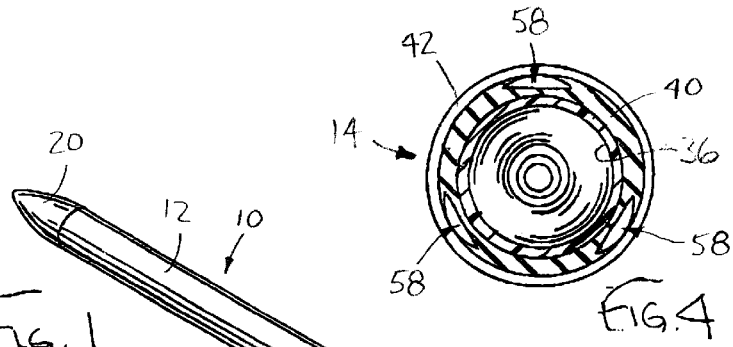
FIG. 4
FIG. 1
FIG. 2
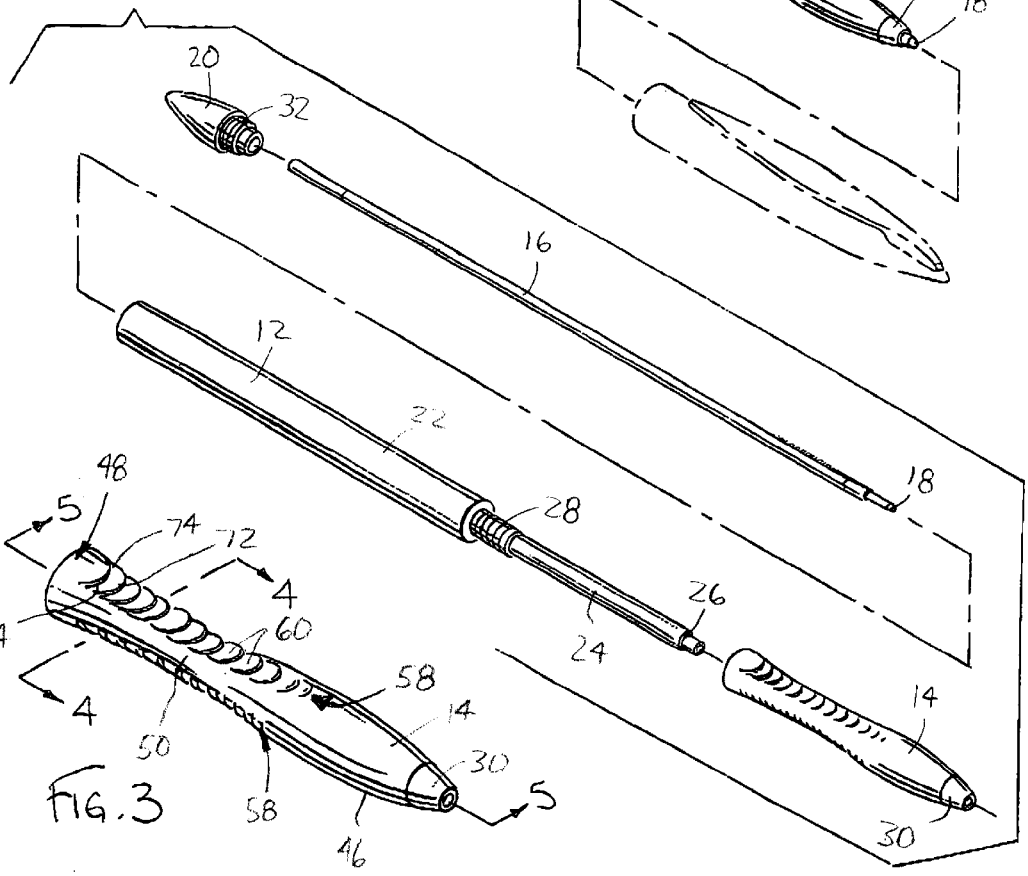
FIG. 3
FIG. 5
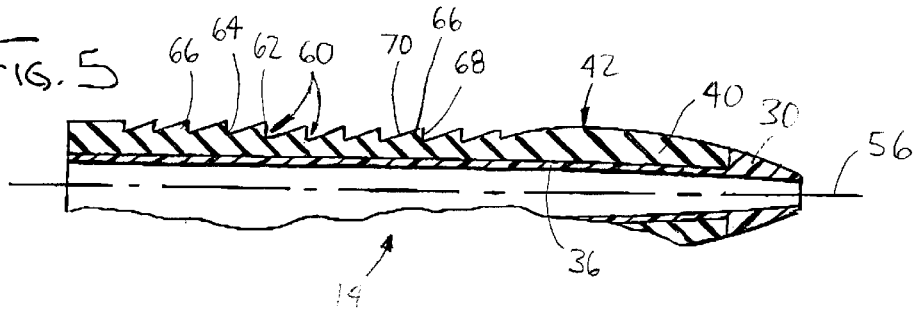

WRITING IMPLEMENT

BACKGROUND OF THE INVENTION

1. Field of the Invention

The invention relates generally to writing implements and, more particularly, the invention relates to writing implements incorporating a finger grip.

2. Description of the Related Technology

A wide variety of manual writing implements exist, such as ball point pens, fountain pens, felt tip markers, mechanical pencils, etc. Each writing implement is typically held in a user's hand and manipulated to produce marks on a writing surface, such as the surface of a sheet of paper. The writing implement has a writing member disposed partially therein. The writing member includes a tip exposed at one end of the barrel for making marks. Examples of writing tips include a pen point, such as a ball point, connected to a cylindrical ink cartridge disposed within the barrel, pencil leads, etc.

During use, a user grips the barrel of the writing implement and applies the tip to the writing surface with a pressure force. In order to produce desired marks, or simply as a result of the user's natural writing technique, the pressure force applied to the writing surface may be great. As a result, the user's fingers, wrist, and hand may be strained, resulting in fatigue and discomfort. In addition, when a writing implement is used over long periods of time, callouses may develop on the user's fingers.

Conventional writing implements have employed a variety of different grips in an attempt to improve comfort and control during use. Some writing implements have an ergonomic grip made of a resilient material. The grip may be contoured, such as in a "hourglass" shape, to further improve comfort. Other writing implements have a deformable -rip for improved comfort. It is known to form such a grip by providing a deformable sleeve containing a relatively viscous putty substance that holds a deformed shape for a period of time before resuming an undeformed shape.

In addition, gripping devices are known for use with a hand-held implement. The gripping devices may include a hollow cored tubing member having an internal diameter sized to fit over a grip portion of the hand-held implement. A plurality of annular ribs may extend about an exterior surface of the hollow cored tubing member. Each rib is formed with an internal jell filled chamber that is isolated from the gel filled chamber of adjacent annual ribs.

While these designs were intended to improve comfort and stability during use, there is nevertheless a perceived consumer desire for writing implement grips that are more comfortable to the user and that improve stability of the writing implement during use.

SUMMARY OF THE INVENTION

In view of the foregoing, a writing implement is provided including a barrel having a front end and a writing member partially disposed in the barrel and having a tip extending outside the front end of the barrel. A resilient gripping portion is attached to the barrel and defines an outer surface. A column of arcuate grooves is formed in the gripping portion outer surface, the grooves being aligned longitudinally to form interposed ribs shaped to resist slippage away from the tip.

In accordance with additional aspects of the invention, a writing implement is provided including a barrel having a front end and a writing member partially disposed in the barrel, the writing member having a tip extending outside the front end of the barrel. A resilient gripping portion is attached to the barrel and defines an outer surface, and a column of arcuate grooves is formed in the gripping portion outer surface. The grooves are aligned longitudinally along the gripping portion, each groove defining a front edge located near the tip and a rear edge located farther from the tip. The rear edge of each groove has a depth greater than that of the associated forward groove edge.

In accordance with further aspects of the invention, a writing implement is provided including a barrel having a front end and a writing member partially disposed in the barrel and having a tip extending outside the front end of the barrel. A resilient gripping portion is attached to the barrel and defines an outer surface, and a column of arcuate grooves are formed in the gripping portion outer surface. The grooves are aligned longitudinally along the gripping portion, each groove having a central portion located nearest the tip and two end portions located farther from the tip.

Other features and advantages are inherent in the apparatus claimed and disclosed or will become apparent to those skilled in the art from the following Detailed Description and its accompanying drawings.

BRIEF DESCRIPTION OF THE DRAWINGS

FIG. 1 is a perspective view of a writing implement including a grip constructed in accordance with the teachings of the present invention.

FIG. 2 is an exploded perspective view of the writing implement.

FIG. 3 is an enlarged perspective view of the grip.

FIG. 4 is a cross-sectional view of the grip taken along line 4—4 of FIG. 3.

FIG. 5 is a cross-sectional view of the grip taken along line 5—5 of FIG. 3.

DETAILED DESCRIPTION OF THE PREFERRED EMBODIMENT

Referring now to the drawings, a writing implement 10 according to one embodiment of the present invention is illustrated at FIG. 1. As shown, the writing implement 10 includes a barrel 12 having a grip 14 attached thereto. In the preferred embodiment, the barrel 12 is formed of plastic, however, other suitable materials commonly used for writing implements may also be used, such as wood, metal, etc. The grip 14 is made of a resilient material such as soft rubber. A writing member, such as ink cartridge 16 (FIG. 2), is partially supported inside the barrel 12 and has tip 18 extending outside the front end of the grip 14. An end plug 20 is attached to and closes off a rear end of the barrel 12.

As best shown in FIG. 2, the barrel 12 includes a larger diameter rear section 22 and a smaller diameter forward section 24. The forward section 24 has an inside diameter sized to receive the ink cartridge 16 and is formed with an internal shoulder 26 sized to engage a leading edge of the ink cartridge 16 while allowing the tip 18 to pass therethrough. Near its connection to the rear section 22, the forward section 24 has a small-diameter threaded portion 28. The rear end of the rear section 22 has a large diameter internal thread portion (not shown).

The end plug 20 is releasably attached to the rear section 22 of the barrel 12. As best shown in FIG. 2, the end plug 20 has an external thread portion 32 adapted to releaseably engage the large diameter internal thread portion of the barrel 12. The end plug 20 may further includes means for frictionally engaging a rear end of the ink cartridge 16, such as internal bosses (not shown).

The grip 14 (FIG. 3) is attached to the front end of the barrel 12 to provide a stable and comfortable grip to the user. As best illustrated in FIG. 4, the grip 14 has an internal shaft 36 sized to receive the forward section 24 of the barrel 12. In the illustrated embodiment, a front end 30 of the internal shaft 36 is exposed near the tip 18. A rear end of the grip internal shaft 36 is formed with internal threads (not shown) sized to releasably engage the small diameter threaded portion 28 of the barrel forward section 24. A grip layer 40 surrounds the internal shaft 36 to provide an outer gripping surface 42. In a preferred embodiment, the internal shaft 36 is formed of a relatively inflexible material, such as a polypropylene or other hard plastics, while the grip layer 40 is formed of a resilient material. Suitable resilient materials include thermo-plastic elastomers, soft rubber, pvc, and silicone.

While the grip 14 is illustrated as having an internal shaft 36 with an outer grip layer 40, other grip constructions may be provided in accordance with the present invention. For example, the entire grip 14 may be provided as a single piece of resilient material that is formed with an internal bore having a threaded section for engaging the barrel threaded portion 28.

To assemble the writing implement, the rear end of the ink cartridge 16 is inserted into the frictionally engaging means of the end plug 20. The tip 18 of the ink cartridge 16 is inserted through the barrel 12 until the end plug 20 is adjacent the rear end of the barrel 12, and the end plug 20 is rotated relative to the barrel 12 thereby to releasably secure the end plug 20 to the barrel 12. As the end plug 20 is attached to the barrel 12, the tip 18 extends outside the front end of the barrel 12. As noted above, the internal shoulder 26 of the barrel 12 allows the tip 18 to pass therethrough while engaging the body of the ink cartridge 16. The grip 14 is then inserted over the barrel forward section 24 until the internal threads at the rear end of the internal shaft 36 are adjacent the small diameter threaded portion 28 of the barrel forward section 24. The grip 14 is rotated relative to the barrel 12 to threadably secure the grip 14 to the barrel 12. Once the grip 14 is fully fastened, the tip 18 extends through the front end of the grip 14.

The outer gripping surface 42 of the grip 14 is preferably shaped to provide an attractive appearance and increase comfort to the user. As best shown in FIG. 1, a rear portion of the outer gripping surface 42 substantially matches the shape and size of the barrel outer surface 44. As a result, the writing implement 10 has a consistent appearance. In addition, the outer gripping surface 42 has an ergonomic contour to better fit the user's fingers. In the illustrated embodiment, a front end of the grip 14 near the tip 18 is formed with a rounded portion 46, a rear end of the grip 14 has a flared portion 48, and an intermediate neck portion 50 joins the flared portion 48 to the rounded portion 46.

In the illustrated embodiment, the resilient outer gripping surface 42 extends near the tip 18 to improve stability during use of the writing implement 10. As best shown in FIG. 3, the front end 30 of the internal shaft 36 is exposed to facilitate manufacture of the grip. The exposed portion is preferably minimized so that the outer gripping surface 42 extends as near as possible to the tip 18. The closer to the tip that a user is able to hold a writing implement, the greater the control the user will have over the writing implement. By extending the resilient outer gripping surface 42 near the tip 18, the user is able to hold the writing implement 10 closer to the tip 18, thereby increasing control and stability during use.

In accordance with certain aspects of the invention, the outer gripping surface 42 is provided with means for preventing the fingers of a user from slipping away from the tip 18. As best understood with reference to FIG. 3, multiple columns 58 of arcuate grooves 60 are formed in the outer gripping surface 42 to prevent slippage away from the tip IS. Each column 58 is aligned in a longitudinal direction, defined herein as parallel to an axis 56 of the writing implement 10. As best shown in FIG. 5, each groove 60 has a front edge 62 located nearest the tip 18 and a rear edge 64 located farther from the tip 18. The depth of each groove 60 from the outer gripping surface 42 increases from the front edge 62 to the rear edge 64.

The grooves 60 of column 58 are longitudinally spaced so that a fib 66 is formed between each adjacent pair of grooves 60 (FIG. 5). Each rib 66 is shaped to have, with respect to the axis 56, a relatively steep leading edge 68 and a tapered but generally flat trailing edge 70. As a result, the ribs 66 provide a "fishhook" effect, in which the ribs offer little resistance to movement of the user's fingers toward the tip 18, but significantly resist movement away from the tip 18.

In the illustrated embodiment, the grooves 60 are preferably formed in an arcuate shape. As best shown in FIG. 3, each groove 60 has a central portion 72 located nearer the tip 18 and end portions 74 located farther from the tip 18. The arcuate shape varies the slip-resistance by altering the depth of the grooves 60.

While the invention has been described with reference to specific examples, which are intended to be illustrative only and not to be limiting of the invention, it will be apparent to those of ordinary skill in the art that changes, additions, or deletions may be made to the disclosed embodiments without departing from the spirit and the scope of the invention.

What is claimed is:

1. A writing implement comprising:

a barrel extending along an axis and having a front end;

a writing member partially disposed in the barrel and having a tip extending outside the front end of the barrel;

a resilient gripping portion attached to the barrel and defining an outer surface; and a column of grooves formed in the gripping portion outer surface, the grooves being aligned longitudinally along the gripping portion, each groove defining a front edge located nearer the tip and rear edge located farther from the tip;

wherein the rear edge of each groove has a depth in a direction normal to the axis that is greater than that of the associated forward groove edge.

2. The writing implement of claim 1, in which adjacent grooves define a rib therebetween.

3. The writing implement of claim 2, in which the barrel defines an axis, and in which each rib has a leading edge located nearer the tip and a trailing edge located farther from the tip, the leading edge sloping more steeply with respect to the axis than the trailing edge.

4. The writing implement of claim 1, in which each groove has an arcuate shape.

5. The writing implement of claim 4, in which each groove has a central portion located nearer the tip and two end portions located farther from the tip.

6. The writing implement of claim 1, in which the gripping portion outer surface comprises soft rubber.

7. The writing implement of claim 1, in which the gripping portion outer surface is formed with an ergonomic contour.

8. A writing implement comprising:

a barrel having a front end and defining an axis;

a writing member partially disposed in the barrel and having a tip extending outside the front end of the barrel;

a resilient gripping portion attached to the barrel and defining an outer surface; and a column of grooves formed in the gripping portion outer surface, the grooves aligned longitudinally to form interposed ribs having a leading edge located nearer the tip and a trailing edge located farther from the tip, each leading edge sloping more steeply with respect to the axis than each associated trailing edge;

wherein the ribs resist slippage of a user's hands away from the tip.

9. The writing implement of claim 8, in which each groove has an arcuate shape.

10. The writing implement of claim 9, in which each groove has a central portion located nearer the tip and two end portions located farther from the tip.

11. The writing implement of claim 8, in which each groove has a front edge located nearer the tip and a rear edge located farther from the tip.

12. The writing implement of claim 11, in which each groove has a varying depth.

13. The writing implement of claim 12, in which the depth of each groove increases from the front edge to the rear edge.

14. A writing implement comprising:

a barrel having a front end;

a writing member partially disposed in the barrel and having a tip extending outside the front end of the barrel;

a resilient gripping portion attached to the barrel and defining an outer surface; and a column of acuate grooves formed in the gripping portion outer surface, the grooves aligned longitudinally along the gripping portion, each groove having a central portion located nearer the tip and two end portions located farther from the tip, wherein each groove has a varying depth.

15. The writing implement of claim 14, in which adjacent grooves define a rib there between.

16. The writing implement of claim 15, in which the barrel defines an axis, each rib has a leading edge and a trailing edge, and the leading edge of each rib slopes more steeply with respect to the axis than the trailing edge.

17. The writing implement of claim 14, in which each groove has a front edge located nearer the tip and rear edge located farther from the tip, wherein the rear edge of each groove has a depth greater than that of the associated forward groove edge.

18. The writing implement of claim 14, in which the gripping portion outer surface comprises soft rubber.

19. The writing implement of claim 14, in which the gripping portion outer surface is formed with an ergonomic contour.

* * * * *